US010864924B2

(12) United States Patent
Richard

(10) Patent No.: US 10,864,924 B2
(45) Date of Patent: Dec. 15, 2020

(54) DEVICE FOR COUPLING A VEHICLE TO A TRACTION CABLE, VEHICLE PROVIDED WITH SUCH A DEVICE, AND TRANSPORT INSTALLATION BY TRACTION CABLE INCLUDING SUCH A VEHICLE

(71) Applicant: POMA, Voreppe (FR)

(72) Inventor: Jérôme Richard, Crolles (FR)

(73) Assignee: POMA, Voreppe (FR)

( * ) Notice: Subject to any disclaimer, the term of this patent is extended or adjusted under 35 U.S.C. 154(b) by 342 days.

(21) Appl. No.: 15/739,472

(22) PCT Filed: Jun. 10, 2016

(86) PCT No.: PCT/FR2016/051414

§ 371 (c)(1),
(2) Date: Dec. 22, 2017

(87) PCT Pub. No.: WO2016/198805

PCT Pub. Date: Dec. 15, 2016

(65) Prior Publication Data

US 2018/0194371 A1 Jul. 12, 2018

(30) Foreign Application Priority Data

Jun. 12, 2015 (FR) ..... 15 55375

(51) Int. Cl.
*B61B 12/12* (2006.01)
*B61B 7/04* (2006.01)
(Continued)

(52) U.S. Cl.
CPC ..... *B61B 12/122* (2013.01); *B61B 7/04* (2013.01); *B61B 12/10* (2013.01); *B61B 12/12* (2013.01);
(Continued)

(58) Field of Classification Search
CPC ..... B61B 9/00; B61B 12/10; B61B 12/12; B61B 12/122; B61B 12/127; B61B 13/125
See application file for complete search history.

(56) References Cited

U.S. PATENT DOCUMENTS 3,166,021 A 1/1965 Schippers
4,402,272 A * 9/1983 Habegger ..... B61B 5/02 104/119
(Continued)

FOREIGN PATENT DOCUMENTS

CN 102150501 A 8/2011
DE 304837 C * 2/1917
(Continued)

OTHER PUBLICATIONS

Oct. 30, 2018 Office Action issued in Russian Patent Application No. 2018100680/11(000876).
(Continued)

*Primary Examiner* — Ryan A Reis
(74) *Attorney, Agent, or Firm* — Oliff PLC

(57) ABSTRACT

Device for coupling a vehicle to a traction cable, comprising a fastening configured to couple the vehicle to the traction cable, the fastening including at least two rotatable elements configured to occupy a coupling position in which said at least two rotatable elements are in contact with the traction cable and the vehicle is coupled to the traction cable, the device including a variable speed drive configured to modify a speed of rotation of said at least two rotatable elements when said at least two rotatable elements are in the coupling position, so that the vehicle moves relative to the traction cable.

24 Claims, 7 Drawing Sheets

(51) Int. Cl.

| | |
|---|---|
| ***B61B 12/10*** | (2006.01) |
| ***B61B 13/12*** | (2006.01) |
| *B61B 9/00* | (2006.01) |
| *B61C 17/00* | (2006.01) |

(52) U.S. Cl.
CPC ..... *B61B 12/127* (2013.01); *B61B 13/125* (2013.01); *B61B 9/00* (2013.01); *B61C 17/00* (2013.01)

(56) References Cited

U.S. PATENT DOCUMENTS

| | | | | |
|---|---|---|---|---|
| 4,512,259 | A * | 4/1985 | Huon de Kermadec | B61B 12/12 104/208 |
| 4,716,838 | A * | 1/1988 | Huon De Kermadec | B61B 12/12 104/173.1 |
| 4,785,739 | A * | 11/1988 | Huon de Kermadec | B61B 12/06 104/208 |
| 5,517,923 | A | 5/1996 | Cathiard | |
| 2008/0115689 | A1 * | 5/2008 | Heil | B61B 9/00 104/242 |
| 2011/0226152 | A1 | 9/2011 | Mollet | |
| 2012/0024187 | A1 | 2/2012 | Beck | |
| 2012/0090494 | A1 | 4/2012 | Beck | |

FOREIGN PATENT DOCUMENTS

| | | | |
|---|---|---|---|
| DE | 304837 | C | 2/1917 |
| FR | 2719011 | A1 | 10/1995 |
| FR | 3013298 | A1 | 5/2015 |
| RU | 2011 136 938 | A | 3/2013 |
| RU | 2 516 858 | C2 | 5/2014 |
| WO | 2015/071573 | A2 | 5/2015 |

OTHER PUBLICATIONS

Sep. 6, 2016 Search Report issued in International Patent Application No. PCT/FR2016/051414.
Sep. 6, 2016 Written Opinion issued in International Patent Application No. PCT/FR2016/051414.
Nov. 14, 2018 Office Action issued in Chinese Patent Application No. 201680033937.6.

* cited by examiner

DEVICE FOR COUPLING A VEHICLE TO A TRACTION CABLE, VEHICLE PROVIDED WITH SUCH A DEVICE, AND TRANSPORT INSTALLATION BY TRACTION CABLE INCLUDING SUCH A VEHICLE

BACKGROUND OF THE INVENTION

The invention relates to coupling of vehicles to a traction cable, and more particularly to transport installations by overhead traction cable.

STATE OF THE ART

At present, vehicles towed by either an overhead or a ground cable comprise a fastening to couple the vehicles to the traction cable. The fastenings are said to be fixed when they couple the vehicles in permanent manner to the traction cable. The fixed fastenings can be fixed grips which grip the traction cable in a position of the cable which remains constant throughout the running travel of the vehicles. Another type of fixed fastenings exists which comprises two plates riveted to one another, a portion of the traction cable being diverted between the two plates in a V-shaped curve, also referred to as a "cocked hat". But these fixed fastenings do not enable the transit rate of the passengers to be increased, as the traction cable has to be stopped to immobilize the vehicles so that the passengers can load and unload from the vehicles.

Other fastenings are said to be detachable when they couple the vehicles in removable manner to the traction cable. An urban ground cable traction transport system can for example be cited, which comprises a detachable grip to grip or release the traction cable in movement. But the speed of the traction cable is not very high, about 15 km/h, and does not provide a high passenger transit rate. Furthermore, the vehicles are coupled to the traction cable when they are at a standstill. There is therefore a high friction between the cable and the detachable grip, during the grip, resulting in inopportune wear of the grip and of the traction cable. Furthermore, in case of an incident occurring on a vehicle, the latter may be immobilized on the line, whereas the traction cable remains in movement, which may lead to a risk of collision with a following vehicle.

Detachable overhead traction cable transport systems, such as chair lifts or gondola lifts, can also be cited. In these cases, the vehicles are uncoupled from the traction cable, at present in a terminal or intermediate station, to move them at reduced speed in order to facilitate loading and unloading of the passengers, while at the same time maintaining driving of the traction cable at a higher constant speed. However, the stations have to be provided with launching and deceleration sections of the vehicles to respectively close and open the detachable grips when the vehicles are at the same speed as the traction cable, in order not to damage the grips. These sections are generally long, and their length is moreover proportional to the driving speed of the traction cable. Consequently, when it is desired to increase the driving speed of the traction cable, in particular to increase the passenger transit rate, the length of these sections also has to be increased. These sections are moreover complex, as they are provided with launchers and decelerators provided with motor-driven aligned tyres and with a synchronization system to adjust the speed of the tyres to match the speed of the traction cable.

French Patent application FR2719011 can in addition be cited which discloses a vehicle transport installation provided with two railway rails and a traction cable, in which each vehicle is provided with wheels placed on the rails and with a detachable grip for coupling the vehicle to the traction cable. The vehicles further comprise an electric motor supplied by a rechargeable battery, driving the wheels in order to accelerate the vehicle over the acceleration section so as to reach the running speed of the traction cable. But the vehicles have to be provided with a complex regulating and control unit which has to perform synchronization of the speed of the vehicle with that of the cable, in particular the unit has to control departure and acceleration of the vehicle. The transport installation further must be compulsorily provided with rails, or with carrying cables, in order to be able to accelerate the vehicles.

French Patent application FR3013298 can further be cited which discloses a device for fastening a vehicle to two overhead traction cables, comprising a first fastening to secure the vehicle in removable manner to a first traction cable driven at a first speed and a second fastening to secure the vehicle in removable manner to a second traction cable driven at a second speed lower than the first speed. The first fastening comprises a main pulley designed to suspend and guide the vehicle on the first cable, and two lateral counter-pulleys arranged on each side of the main pulley and movable between a first position in which the vehicle is secured to the first cable, and a second position in which the vehicle is unsecured from the first cable. The second fastening comprises a main pulley designed to suspend and guide the vehicle on the second cable, and a counter-pulley arranged facing the main pulley and movable between a first position in which the vehicle is secured to the second cable and a second position in which the vehicle is unsecured from the second cable. The first and second fastenings further comprise progressive engagement means arranged to manage the progressivity of a griping force of one of the two fastenings on the traction cable at the same time as the other fastening is released. But such a fastening device is not suitable for installations provided with a single traction cable, whether it be of overhead or ground type. Indeed, a first fastening cooperates with a first traction cable and a second fastening cooperates with a second traction cable, each traction cable being used as a support structure of the installation. Such an installation therefore has to be provided with two traction cables having different speeds, which makes such an installation considerably more complex to construct. Furthermore, the progressive engagement means are complex as opening of one fastening has to be synchronized during closing of the other fastening in order to prevent rotation of the vehicle on itself and to prevent a possible tear-off of the first fastening which grips the first cable having the highest speed in the case where the second fastening grips on the second cable before the first fastening has been released.

OBJECT OF THE INVENTION

One object of the invention consists in remedying these drawbacks, and more particularly in providing means for simplifying transport installations by traction cable, in particular by minimizing the length of the stations of these installations.

According to one feature of the invention, a device for coupling a vehicle to a traction cable is proposed, comprising a fastening configured to couple the vehicle to the traction cable, the fastening comprising at least two rotatable elements configured to occupy a coupling position in which said at least two rotatable elements are in contact with the traction cable and the vehicle is coupled to the traction cable.

The coupling device comprises a regulating means configured to modify a speed of rotation of said at least two rotatable elements when said at least two rotatable elements are in the coupling position, so that the vehicle moves relative to the traction cable.

A coupling device is thus provided enabling the speed of the vehicle to be modified, while at the same time keeping the speed of the traction cable constant. Indeed, rotation of the rotatable elements enable the vehicle to move relative to the traction cable, while keeping the vehicle coupled to the traction cable, i.e. the fastening is kept mechanically linked to the traction cable. Furthermore, the speed of the rotatable elements can be modified when the vehicle is coupled to the traction cable in order to be able to slow the vehicle down until the latter is stopped, or to accelerate the vehicle in the running direction of the cable starting from an immobile position of the vehicle. The stations of the installation therefore no longer have to be provided with acceleration and deceleration sections of the vehicles which are long and complex. Furthermore, when the rotatable elements have a lower speed than that of the traction cable, the vehicle remains towed by the traction cable.

The regulating means can further be configured to block said at least two rotatable elements in rotation when said at least two rotatable elements are in the coupling position, so that the vehicle is immobile relative to the traction cable.

The vehicle can thus be towed at the speed of the traction cable.

Each rotatable element can comprise at least one sheave mounted movable in rotation.

At least one rotatable element can comprise a strip designed to be fitted between the traction cable and said at least one sheave of said at least one rotatable element when said at least two rotatable elements are in the coupling position.

The fastening can comprise at least three rotatable elements arranged to divert a portion of the traction cable inside the fastening when said at least three rotatable elements are in the coupling position.

Coupling of the vehicle to the traction cable is thus improved by wedging the cable by deviation between at least three rotatable elements.

The regulating means can comprise a variable speed drive coupled to at least one rotatable element.

The device can comprise a carriage on which the fastening is mounted, the carriage comprising wheels designed to roll on a support structure, the variable speed drive being controlled and provided with an input shaft coupled to said at least one rotatable element and with an output shaft coupled to the input shaft and to at least one wheel of the carriage, the device comprising a control unit coupled to the variable speed drive to control the speed of rotation of said at least two rotatable elements.

Such a device is particularly suitable for cable transport installations which use support structures to secure transport of the vehicles. The wheels of the carriage facilitate the movements of the vehicle relative to the traction cable when the regulating means modify the speed of rotation of the rotatable elements.

The variable speed drive can comprise two cones arranged head-to-tail and respectively coupled to the input and output shafts, and a transmission belt connected to the two cones, the control unit being configured to move the transmission belt in order to control the speed of rotation of said at least two rotatable elements.

At least one rotatable element can be mounted movable in translation between the coupling position in which the vehicle is coupled to the traction cable and an uncoupling position in which the vehicle is uncoupled from the traction cable.

A fastening of detachable type is thus provided.

The fastening can comprise a housing to receive the traction cable, the housing extending along a main axis, the device comprising guide means situated along the main axis when said at least two rotatable elements are in the coupling position in order to hold the traction cable in the housing.

The guide means are particularly suitable to facilitate running over the pillars of the installation, in particular to hold the traction cable in the fastening housing.

The device can further comprise a detachable grip configured to couple the vehicle to the traction cable in removable manner.

Such a grip enables coupling of the vehicle to the traction cable to be reinforced, which secures traction of the vehicle, in particular at the level of the portions of the traction cable which are inclined relative to the horizontal.

The device can comprise a launcher to move at least one rotatable element in rotation when said at least one rotatable element is in the uncoupling position.

According to another feature of the invention, a vehicle designed to be coupled to a traction cable is proposed, comprising a coupling device as defined in the foregoing.

According to another feature of the invention, a transport installation by traction cable is proposed, comprising at least one vehicle as defined in the foregoing.

The installation can comprise a support structure to support said at least one vehicle.

BRIEF DESCRIPTION OF THE DRAWINGS

Other advantages and features will become more clearly apparent from the following description of particular embodiments of the invention given for non-restrictive example purposes only and represented in the appended drawings, in which.

DETAILED DESCRIPTION

Figure 1:
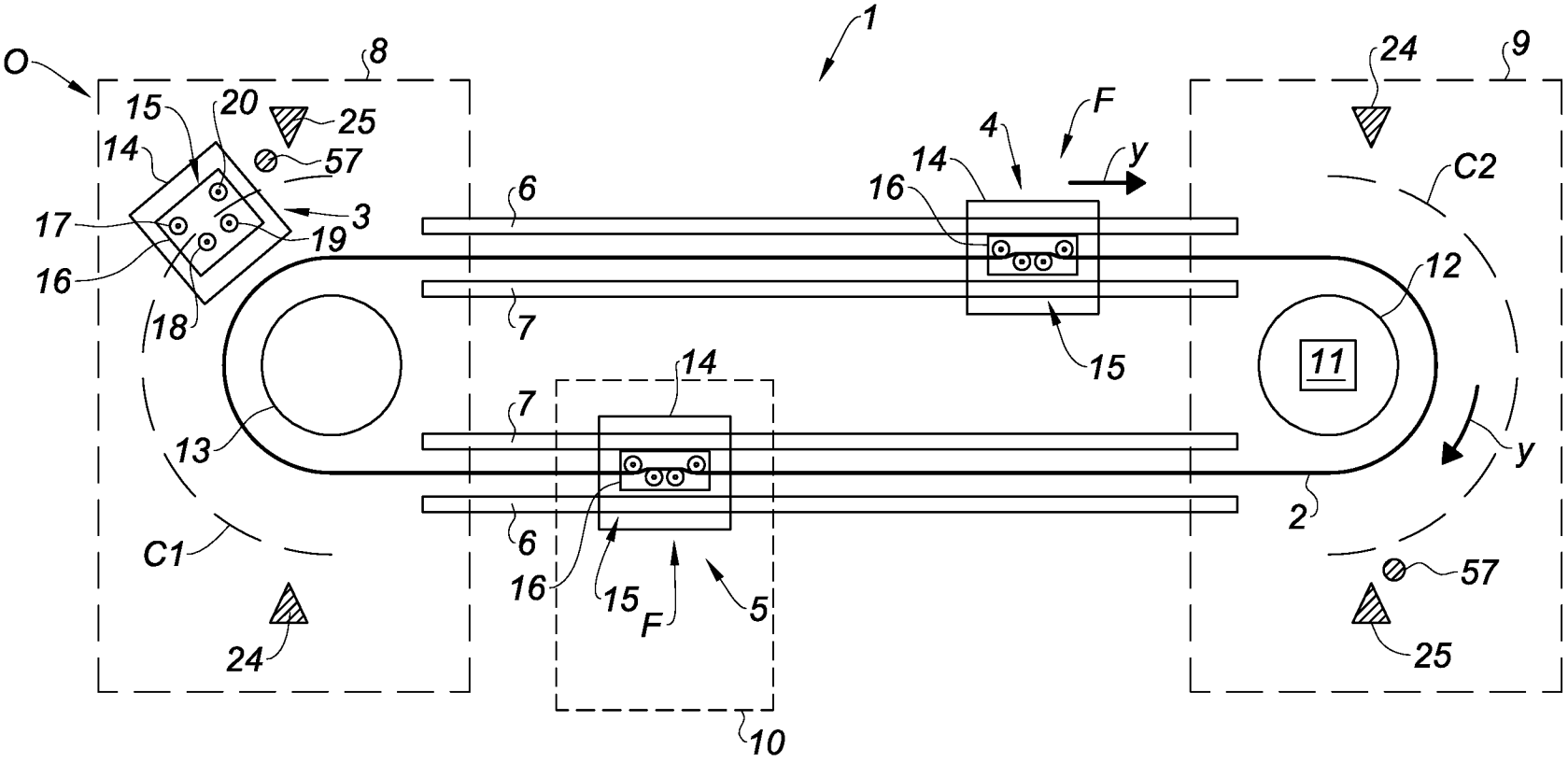
FIG. 1 schematically illustrates an embodiment of a transport installation by traction cable according to the invention.

In FIG. 1, an embodiment of a transport installation 1 by traction cable 2 has been represented. The installation 1 comprises vehicles 3 to 5 designed to be coupled to the traction cable 2, to be towed in order to transport people or goods. The installation 1 can be an aerial cable car of any type, for example of mono-cable or bi-cable type. An aerial cable car is a transport installation with overhead traction cables and carrying cables, and the vehicles are suspended above the ground by means of the overhead cables. An aerial mono-cable car 1 comprises at least one cable 2 which is both carrier and traction cable, and an aerial bi-cable car 1 comprises at least one traction cable 2 and at least one carrying cable 6. The transport installation 1 can also comprise a traction cable 2 located at ground level and a support structure comprising one or more support rails 6, 7 on which the vehicles 3 to 5 are placed. As a variant, the installation 1 can comprise at least one overhead traction cable and a support structure 6, 7 designed to support the vehicles 3 to 5. According to this variant, the support structure comprises one or more carrying cables 6, 7; the vehicles 3 to 5 are also said to be suspended from the carrying cables 6, 7.

Preferentially, the installation 1 is of detachable type, i.e. the vehicles 3 to 5 can be uncoupled from the traction cable 2. What is meant by "uncoupled" is the fact that a vehicle 3 to 5 is not mechanically connected to the traction cable 2, in other words the vehicle 3 to 5 is not in mechanical contact with the traction cable 2. On the contrary, what is meant by "coupled" is the fact that the vehicle 3 to 5 is mechanically connected to the traction cable, i.e. that the vehicle 3 to 5 is in mechanical contact with the traction cable 2.

Advantageously, the installation 1 has a continuous traction cable, in other words the traction cable 2 forms a closed loop between two terminal stations 8, 9 of the installation 1, and the vehicles 3 to 5 run continuously along the traction cable 2. In FIG. 1, an embodiment of the installation 1 has been represented wherein the installation 1 is detachable, bi-cable, and with a continuous traction cable 2. The installation 1 further comprises one or more intermediate stations 10, stations 8 to 10 being suitable for loading/unloading of people in the vehicles 3 to 5. More particularly, the installation 1 comprises a drive station 9 provided with a motor 11 to make a driving pulley 12 rotate, driving the traction cable 2 in a direction of movement Y, and a return station 8 comprising a return pulley 13 which serves the purpose of placing the traction cable 2 under tension. Each vehicle 3 to 5 further comprises a cabin 14 able to be a passenger compartment designed to receive passengers or a container designed to contain goods, for example waste.

Furthermore, at least one vehicle 3 to 5 comprises a coupling device 15 to couple the vehicle 3 to 5 to the traction cable 2. In FIGS. 2 to 9, several embodiments of the coupling device 15 have been illustrated. In general manner, the coupling device 15 comprises a fastening 16 configured to couple the vehicle 3 to 5 to the traction cable 2. The fastening 16 comprises at least two rotatable elements 17 to 20, i.e. elements mounted movable in rotation. The rotatable elements 17 to 20 are configured to occupy a coupling position F in which they are in contact with the traction cable 2 and the vehicle 3 to 5 is coupled to traction cable 2. In the coupling position F, the rotatable elements 17 to 20 adhere to the traction cable, i.e. they exert a griping pressure on the traction cable 2. The griping pressure is a minimum pressure which enables the traction cable 2 to tow the vehicle 3 to 5.

Furthermore, when the installation 1 comprises a single overhead cable 2 which is a carrying-traction cable, the griping pressure is sufficient to both tow and suspend the vehicle 3 to 5 via the cable 2. In this case, the vehicle 3 to 5 can be suspended without necessarily equipping the installation 1 with a support structure 6, 7 distinct from the traction cable 2.

Figure 6:
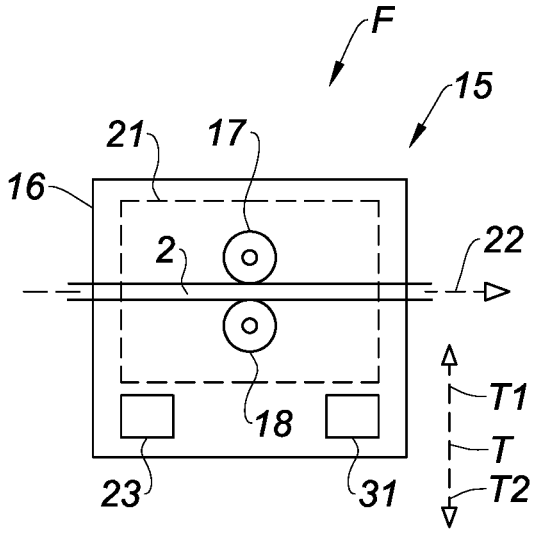
FIGS. 6 and 7 schematically illustrate top views of another embodiment of a fastening where the rotatable elements are respectively in the coupling position and the uncoupling position.
Figure 7:
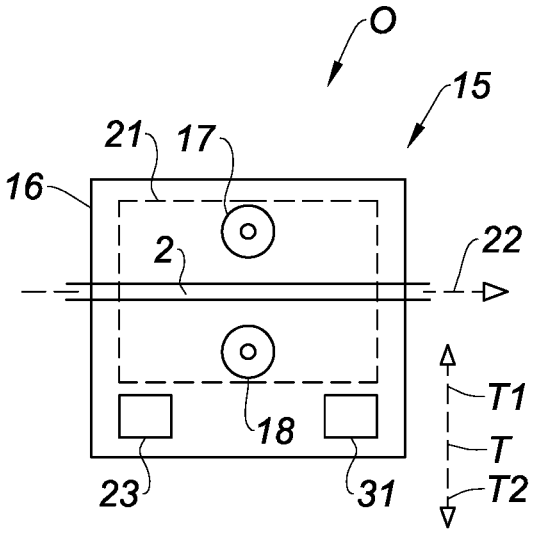
Figure 8:
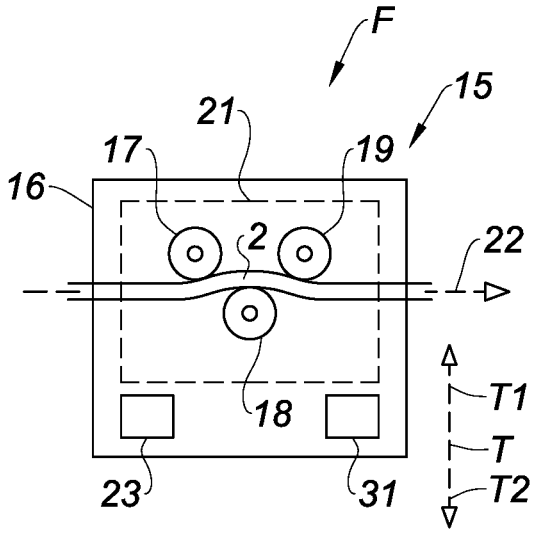
FIGS. 8 and 9 schematically illustrate top views of yet another embodiment of a fastening where the rotatable elements are respectively in the coupling position and the uncoupling position.
Figure 9:
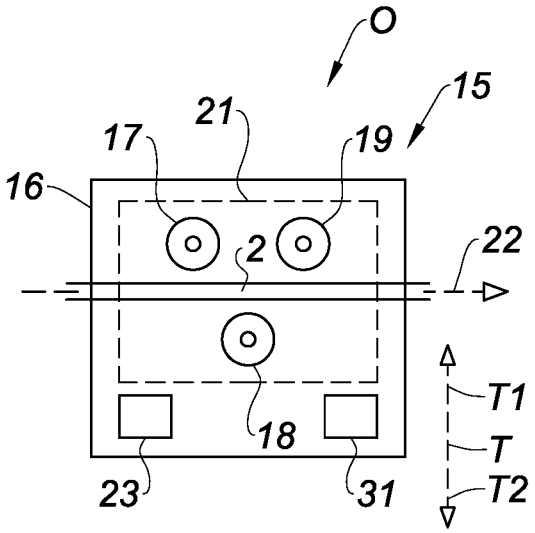

The fastening 16 can comprise several rotatable elements 17 to 20. In FIGS. 6 and 7, the fastening 16 comprises two rotatable elements 17, 18. In FIGS. 8 and 9, the fastening 16 comprises three rotatable elements 17 to 19. In FIGS. 1 to 5, a preferred embodiment has been represented wherein the fastening 16 comprises four rotatable elements 17 to 20. A rotatable element 17 to 20 can comprise at least one sheave, called blocking sheave, mounted movable in rotation. A blocking sheave is a cylindrical or conical wheel. A blocking sheave can be provided with a groove for the traction cable 2 in order to facilitate contact of the blocking sheave against the traction cable 2. More particularly, each blocking sheave 17 to 20 of the fastening 16 is mounted movable in rotation around an axis passing through its centre. According to another example, a rotatable element 17 to 20 can comprise at least one blocking sheave and a strip designed to be fitted between the traction cable 2 and at least one blocking sheave of the rotatable element 17 to 20. The strip can then moved in translation in the driving direction Y of the traction cable 2, when the blocking sheaves are in contact with the strip and are also moved in a rotational direction. In this example, the rotatable element 17 to 20 forms a caterpillar.

The fastening 16 can be configured to couple the vehicle 3 to 5 to the traction cable 2 in fixed manner, as illustrated in FIGS. 6 and 8. The fastening 16 is also said to be fixed. In this case, the rotatable elements 17 to 20 are previously arranged inside the fastening 16 so that they are in contact with the traction cable 2 to couple the vehicle 3 to 5 to the traction cable 2. In particular, the vehicle 3 to 5 is then coupled in a permanent position of the cable 2. According to another embodiment, the fastening 16 can be configured to couple the vehicle 3 to 5 to the traction cable 2 in removable manner, as illustrated in FIGS. 1 to 9. The fastening 16 is also said to be detachable. In this case, at least one rotatable element 17 to 20 is mounted movable in translation between the coupling position F, illustrated in FIGS. 2, 6 and 8, in which the vehicle 3 to 5 is coupled to the traction cable 2, and an uncoupling position O, illustrated in FIGS. 3, 7 and 9, in which the vehicle 3 to 5 is uncoupled from the traction cable 2. Each rotatable element 17 to 20 can be mounted movable in translation. In particular, in the uncoupling position O, the rotatable elements 17 to 20 are no longer in contact with the traction cable 2, and the traction cable 2 can be extracted from the fastening 16, or be inserted into the latter. In other words, the uncoupling position O of the rotatable elements 17 to 20 corresponds to an open position O of the fastening 16, and the coupling position F of the rotatable elements 17 to 20 corresponds to a closed position F of the fastening 16. Whatever the type of fastening 16, fixed or detachable, the coupling position F is identical. That is to say that in the coupling position F, the rotatable elements 17 to 20 are positioned in contact with the traction cable 2 so that they adhere to the traction cable 2. When the rotatable elements 17 to 20 adhere to the traction cable 2, the vehicle 3 to 5 is said to be coupled to the traction cable 2. More particularly, in the coupling position F, the rotatable elements 17 to 20 are immobile in translation relative to the fastening 16. In the coupling position F, the rotatable elements 17 to 20 can be made to move in rotation, or be immobile in rotation, while at the same time maintaining the griping pressure on the traction cable 2. For example, the coupling device 15 can comprise an adhering means 23 configured to place the rotatable elements 17 to 20 in the coupling position F. The adhering means 23 is further configured to exert the griping pressure on at least one rotatable element 17 to 20 against the traction cable 2 so that the rotatable elements 17 to 20 adhere to the traction cable 2. It can also be noted that when the rotatable elements 17 to 20 adhere to the cable 2, the fastening 16 is secured to the traction cable 2.

In general manner, the fastening 16 comprises a housing 21 to receive the traction cable 2. The housing 21 preferably has a longitudinal shape, i.e. it extends along a main axis 22. In other words, the main axis 22 corresponds to the longitudinal axis of the housing 21 of the fastening 16. Furthermore, the rotatable elements 17 to 20 are situated on each side of the fastening 16, i.e. on each side of the main axis 22. In the coupling position F, the rotatable elements 17 to 20 are situated on each side of the traction cable 2, i.e. they are in contact on two different sides of the cable. In the coupling position F, the rotatable elements 17 to 20 cooperate with one another to grip the cable 2 in order to couple the vehicle to the cable 2. In FIGS. 6 and 7, an embodiment of the fastening 16 has been represented comprising two blocking sheaves 17, 18 forming a pair and situated on each side of the main axis 22 of the housing 21. In FIG. 6, the rotatable elements 17 to 20 are in the coupling position F, and they are in contact on two opposite sides of the traction cable 2. In FIGS. 8 and 9, another embodiment of the fastening 16 has been represented comprising three blocking sheaves 17 to 19. A first blocking sheave 18 is situated on one side of the main axis 22, i.e. situated at the level of a first edge of the housing 21, and two other blocking sheaves 17, 19 are situated on the other side of the main axis 22, i.e. situated at the level of a second edge of the housing 21, opposite the first edge. In this case, the set of three blocking sheaves 17 to 19 forms two pairs of blocking sheaves. In FIGS. 2 to 5, a preferred embodiment of the coupling device 15 has been represented wherein the fastening 16 comprises four blocking sheaves 17 to 20. In this preferred embodiment, the set of four blocking sheaves 17 to 20 also forms two pairs of blocking sheaves. Thus, by increasing the number of blocking sheaves 17 to 20, the forces to be provided on the blocking sheaves to grip the traction cable 2 can be limited, when they are in the coupling position F. An enhanced safety can then be ensured to attach the vehicle 3 to 5 to the traction cable 2. Advantageously, the rotatable elements 17 to 20 are situated in a same plane as that containing the main axis 22. Furthermore, when the rotatable elements 17 to 20 are blocking sheaves, they are mounted movable in rotation around their central axis. The central axis of a blocking sheave 17 to 20 passes through the centre of the blocking sheave and extends according to the height of the blocking sheave. In particular, the central axes are situated perpendicularly to the main axis 22. In other words, the central axes of the blocking sheaves are perpendicular to the direction of movement of the vehicle 3 to 5.

When the fastening 16 is detachable, and whatever the number of rotatable elements 17 to 20, the fastening 16 comprises at least one rotatable element 17 to 20 mounted movable in translation according to an axis of translation T, in order to open or close the fastening 16. According to a preferred embodiment, all the rotatable elements 17 to 20 are mounted movable in translation according to the axis of translation T. Preferentially, the axis of translation T is perpendicular to the main axis 22 of the housing 21. Advantageously, the axis of translation T is contained in the plane where the rotatable elements 17 to 20 are situated.

In general manner, the rotatable elements 17 to 20 are configured to be made to move in rotation, or to be immobile in rotation, when they occupy the coupling position F and the traction cable 2 is moving. Rotation of the rotatable elements 17 to 20 further prevents wear of the traction cable 2 and of rotatable elements 17 to 20, when the rotatable elements 17 to 20 are in contact with the traction cable 2. Furthermore, there is little sliding between the traction cable 2 and rotatable elements 17 to 20, and therefore little wear. According to the embodiment illustrated in FIGS. 6 and 7, when the two blocking sheaves 17, 18 are in the coupling position F, they exert the griping pressure on a portion of the traction cable 2. The portion of the traction cable 2 is rectilinear in the housing 21 and extends longitudinally along the main axis 22. According to the other embodiment illustrated in FIGS. 8 and 9, when the blocking sheaves 17 to 19 are in the coupling position F, a portion of the traction cable 2 is diverted inside the fastening 16. The two pairs of blocking sheaves 17 to 19 exert the griping pressure on a portion of the traction cable 2. The portion of the traction cable 2 is then diverted inside the housing 21, i.e. inside the fastening 16. This diversion prevents untimely sliding of the traction cable 2, which may occur when the portion of the cable 2 is rectilinear. According to the preferred embodiment illustrated in FIGS. 2 to 5, when the blocking sheaves 17 to 20 are in the coupling position F, a portion of the traction cable 2 is diverted inside the fastening 16. The two pairs of blocking sheaves 17 to 20 exert the griping pressure on a portion of the traction cable 2 at two successive locations of the traction cable 2, and more particularly at the level of four distinct contact areas on the traction cable 2. The stresses exerted on the portion of the traction cable 2 are thus reduced. In general manner, the rotatable elements 17 to 20 are positioned inside the fastening 16 so that, in the coupling position F, the ends of the portion of the traction cable 2, whether it be diverted or not, are aligned according to the main axis 22 of the housing 21.

In order to provide a detachable fastening 16, the adhering means 23 is further configured to translate the rotatable elements 17 to 20. Preferably, translation of the rotatable elements 17 to 20 is performed in a direction parallel to the translation axis T, i.e. to open or close the fastening 16. The adhering means 23 can comprise a lever and an actuator connected to the lever, not represented for the sake of simplification. The actuator enables a first set of rotatable elements 17, 20 to be translated in a first direction T1 of the translation axis T, and a second set of rotatable elements 18, 19 to be translated in a second direction T2 of the translation axis T opposite from the first direction T1, in order to place the rotatable elements 17 to 20 in the uncoupling position O, and in opposite manner so as to place them in the coupling position F. The actuator can comprise a set of springs, each spring being coupled to a rotatable element 17 to 20 and being controlled by the lever. Furthermore, when the fastening 16 is detachable, the stations 8, 9 each comprise an opening system, for example an opening cam 24, to control opening of the fastening 16, and a closing system, for example a closing cam 25, to control closing of the fastening 16, as illustrated in FIG. 1. The opening and closing cams 24, 25 cooperate with the lever to respectively perform opening and closing of the fastening 16. The opening cams 24 are placed at the entry of the terminal stations 8, 9 to make the lever rock and trigger opening of the fastenings 16. The closing cams 25 are positioned at the exit of the terminal stations 8, 9 to move the lever back to an initial position and close the fastenings 16.

The coupling device 15 also comprises a regulating means 31 configured to modify a speed of rotation Vg of the rotatable elements when the rotatable elements 17 to 20 are in the coupling position F. In other words, the regulating means 31 enables the rotatable elements 17 to 20 to be made to move in rotation, or to be blocked in rotation, when the rotatable elements 17 to 20 are in the coupling position F. In general manner, the regulating means 31 is configured to apply friction on the rotatable elements 17 to 20 in order to slow down their rotation, or even to immobilize them in rotation, or to reduce the friction to increase the speed of rotation of the rotatable elements 17 to 20. In particular, when the regulating means 31 reduces the friction on the rotatable elements 17 to 20, the traction cable 2 drives the rotatable elements 17 to 20 in rotation. The regulating means 31 can comprise a variable speed drive coupled to at least one rotatable element 17 to 20. The variable speed drive can for example be a brake, or a clutch, or a gearbox. When the speed of rotation Vg of the rotatable elements 17 to 20 is modified and the vehicle 3 to 5 is coupled to the traction cable 2, the vehicle 3 to 5 can then move relative to the traction cable 2. In this case, the vehicle 3 to 5 can have a different speed from a speed of running Vc of the traction cable 2. In particular, when the speed of rotation Vg of the rotatable elements 17 to 20 is zero, the rotatable elements 17 to 20 are immobile in rotation and the vehicle 3 to 5 is immobile relative to the traction cable 2, whereas the traction cable 2 is driven at the constant running speed Vc. In this case, the speed of the vehicle 3 to 5 is equal to that of the traction cable 2. When the speed of rotation Vg of the rotatable elements 17 to 20 is increased, the speed of the vehicle 3 to 5 becomes lower than the running speed Vc, and in this case the vehicle is slowed down relative to the installation 1.

Advantageously, the coupling device 15 comprises a carriage 26 on which the fastening 16 is mounted. The carriage 26 is particularly suitable for installations 1, either with an overhead cable or a cable located at ground level, provided with a support structure 6, 7. The carriage 26 comprises wheels 27 to 30 situated on each side of the carriage 26. The wheels 27 to 30 of the carriage 26 are designed to roll on the support structure 6, 7 of the installation 1. The coupling device 15 preferably comprises a controlled variable speed drive and a control unit 32 of the speed drive coupled to the latter by means of a connection 33. The control unit 32 enables the speed of rotation Vg of the rotatable elements 17 to 20 to be controlled when the rotatable elements 17 to 20 are in the coupling position F. For example, the carriage 26 can comprise four drive wheels 27 to 30, i.e. four wheels coupled to the variable speed drive. Preferably, the carriage 26 comprises two free wheels 27, 28, and two drive wheels 29, 30. The variable speed drive comprises an input shaft 34 coupled to at least one rotatable element 17 to 20 and an output shaft 35 coupled to the input shaft 34 and to at least one wheel 27 to 30 of the carriage 26. The variable speed drive can be a mechanical speed drive, for example a variable speed drive with cones, a toroidal variable speed drive or a chain-driven variable speed drive. The variable speed drive can also be a speed drive with electric, hydraulic or pneumatic components. A toroidal variable speed drive comprises a drive disc driven by the input shaft 34, a driven disc driving the output shaft 35, and movable sheaves coupled to the discs to transmit the speed from one shaft to the other. A chain-driven speed drive also comprises a drive disc and a driven disc in which a transmission by chaining is engaged in grooves of the discs to be engaged by the discs. In general manner, the variable speed drive enables a gearing ratio between the output shaft 35 and the input shaft 34 to be made to vary. In other words the variable speed drive enables the speed of the input shaft 34 to be made to vary, i.e. varying the speed of rotation of the rotatable elements 17 to 20, to modify the speed of rotation Vr of the drive wheels 29, 30 of the carriage 26. The regulating means 31 thereby enables the carriage 26 to be speeded-up or slowed-down at any location of the path of the vehicle 3 to 5, while at the same time maintaining a constant running speed of the traction cable 2.

Figure 2:
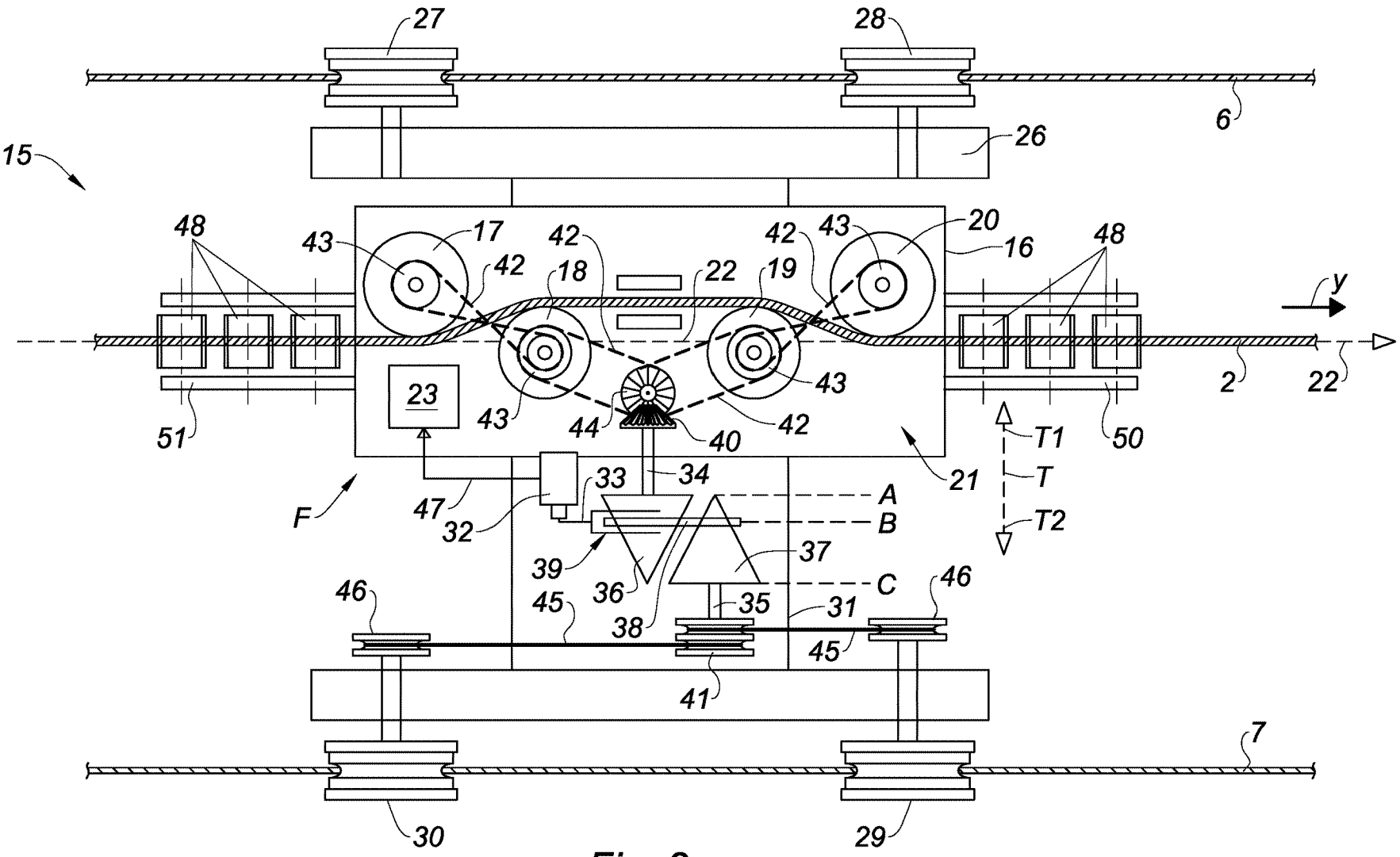
FIG. 2 schematically illustrates a top view of an embodiment of a coupling device where the rotatable elements are in the coupling position.
Figure 3:
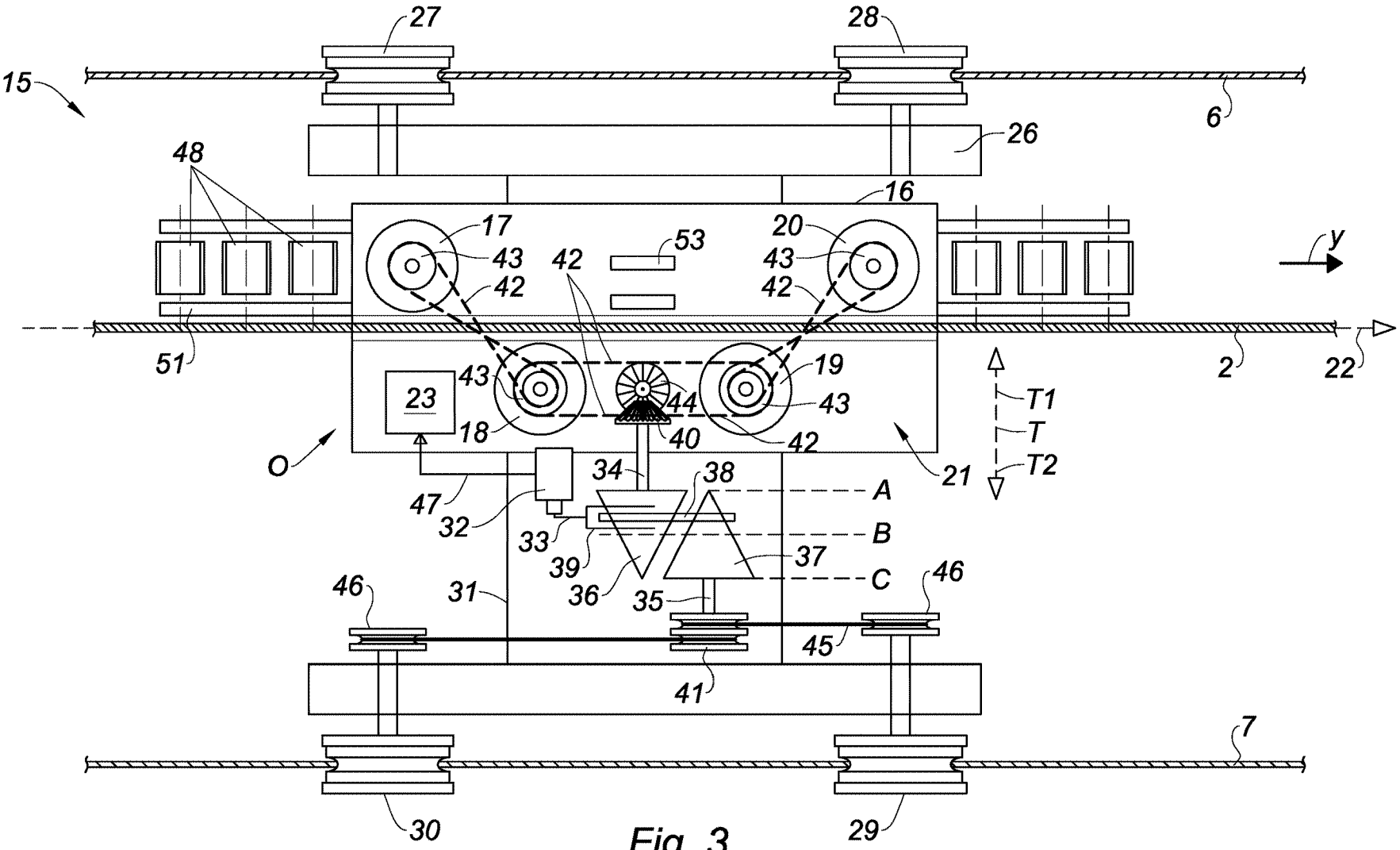
FIG. 3 schematically illustrates a top view of an embodiment of a coupling device where the rotatable elements are in the uncoupling position.

In FIGS. 2 and 3, an embodiment has been represented wherein the regulating means 31 comprises a variable speed drive with cones. The fastening 16 further comprises four blocking sheaves 17 to 20. The variable speed drive comprises a first cone 36, a second cone 37, and a transmission belt 38 connected to the two cones 36, 37. The variable speed drive can comprise a fork 39 to move the transmission belt 38 in order to modify the speed of rotation Vg of the rotatable elements. The variable speed drive further comprises a pinion 40 mounted fixed on one end of the input shaft 34, and a drive pulley 41 mounted fixed on one end of the output shaft 35. The fastening 16 can further comprise drive belts 42 of the blocking sheaves 17 to 20. The drive belts 42 connect the blocking sheaves 17 to 20 to one another by means of drive pulleys 43 respectively mounted on the blocking sheaves 17 to 20. The fastening 16 further comprises a toothed wheel 44 coupled to at least one blocking sheave 17 to 20 by means of a drive belt 42.

When the blocking sheaves 17 to 20 are driven in rotation, they therefore drive the toothed wheel 44, and vice versa. The pinion 40 intermeshes with the toothed wheel 44 of the fastening 16. The drive pulley 41 is for its part coupled to the drive wheels 29, 30 of the carriage 26 by means of drive belts 45 of the wheels of the carriage 26, and of drive pulleys 46 of the carriage 26. The drive pulleys 46 of the carriage 26 are respectively coupled to the drive wheels 29, 30. The cones 36, 37 of the variable speed drive are furthermore arranged head-to-tail, i.e. the second cone 37 is inverted by 180° relative to the first cone 36. Each cone 36, 37 comprises a base and a peak. The base of the first cone 36 is connected to the input shaft 34, and the base of the second cone 37 is connected to the output shaft 35.

The control unit 32 is further configured to control the variable speed drive in order to vary the speed of rotation Vg of the rotatable elements 17 to 20. According to the embodiment illustrated in FIGS. 2 and 3, the control unit 32 controls the position of the fork 39 to control the position of the transmission belt 38. In other words, the control unit 32 controls the position of the transmission belt 38 in order to modify the speed ratio of the variable speed drive. Modifying the position of the transmission belt 38 makes it possible to modify the speed of the first cone 36 or of the second cone 37, i.e. the speed of the output shaft 35 or of the input shaft 34.

The variable speed drive imposes a speed rule of the input shaft 34 and output shaft 35 according to the following equation: $Vte+Vts=Vc$, where Vte is the tangential speed of the input shaft 34, Vts is the tangential speed of the output shaft 35, and Vc is the running speed of the traction cable 2. What is meant by tangential speed of an element is the speed of rotation of the element multiplied by a radius of the element. As the input shaft 34 is coupled to the rotatable elements 17 to 20, it can be driven by the rotation of the rotatable elements 17 to 20. As the output shaft 35 is coupled to the drive wheels 29, 30 of the carriage 26, it can move them in rotation. In general manner, the regulating means 31 also imposes the following equation: $Vtg+Vtr=Vc$, where Vtg is the tangential speed of the rotatable elements 17 to 20, Vtr is the tangential speed of the wheels of the carriage 26, and Vc is the running speed of the traction cable 2. In particular, we have the following equations:

$$Vtg=Rg\times Vg;$$

$$Vtr=Rr\times Vr;$$

with:

Vtg: the tangential speed of the rotatable elements 17 to 20;

Rg: the radius of a rotatable element 17 to 20;

Vg: the speed of rotation of the rotatable element 17 to 20 having the radius Rg;

Vtr: the tangential speed of the wheels 27 to 30 of the carriage 26;

Rr: the radius of a wheel 27 to 30 of the carriage 26;

Vr: the speed of rotation of the wheel 27 to 30 having the radius Rr.

It can be noted that when the rotatable elements 17 to 20 are in the coupling position F, they all have the same tangential speed Vtg, and the wheels 27 to 30 of the carriage all have the same tangential speed Vtr.

When the fork 39 is in position C, we have Vtr=0 and Vtg=Vc, the rotatable elements are driven in rotation by the traction cable 2, their tangential speed Vtg is equal to the speed of the cable 2, and the vehicle 3 to 5 is immobile. When the fork 39 is in position B, Vtg+Vtr=Vc, the blocking sheaves 17 to 20 are driven in rotation by the traction cable 2, their tangential speed Vtg is lower than that of the cable 2, and the vehicle 3 to 5 is towed by the traction cable 2 at a lower speed than that of the cable Vc. When the fork 39 is in position A, we have Vtg=0 and Vtr=Vc, the blocking sheaves 17 to 20 are immobile in rotation, and the vehicle 3 to 5 is towed at the speed Vc of the traction cable.

In FIG. 1, the vehicles 3 to 5 have been represented in three different positions in the installation 1. A first vehicle 3 is situated in the return station 8 where it runs in a bypass circuit C1 of the return station 8. The other terminal station 9 also comprises a bypass circuit C2. The vehicle 3 is also said to be detached, i.e. it is uncoupled from the traction cable 2. In this case, the fastening 16 is in the open position O, and the vehicle 3 is not secured to the traction cable 2. The vehicle 3 is thus detached from the traction cable 2 to run around the return pulley 13 and to then be reattached to the traction cable 2. A second vehicle 4 is situated between the two terminal stations 8, 9. The fastening 16 of the second vehicle is in the closed position F, the rotatable elements 17 to 20 are immobile in rotation, and the vehicle 4 is towed by the traction cable 2 at the running speed Vc of the cable 2. A third vehicle 5 is situated in the intermediate station 10, in an immobile position relative to the installation 1, i.e. parked in the intermediate station 10. In this very particular immobile position, the rotatable elements 17 to 20 of the third vehicle 5 are in the coupling position F, the rotatable elements 17 to 20 are therefore in contact with the traction cable 2, and they are driven in rotation by the latter. The third vehicle 5 is therefore immobile and coupled to the traction cable 2, whereas the traction cable 2 is moving.

When the variable speed drive is a variable speed drive with cones, the control unit 32 controls the speed of the rotatable elements 17 to 20 by moving the transmission belt 38 between position C and position A, and vice versa. In particular, when the transmission belt 38 moves from position C to position A, the vehicle is accelerated, and in opposite manner, when the transmission belt 38 moves from position A to position C, the vehicle is slowed down, i.e. when the transmission belt 38 moves from position C to position A, the tangential speed of the rotatable elements Vtg decreases while the tangential speed Vtr of the wheels of the carriage increases enabling the vehicle to progress along the support structure 6, 7 and to progressively reach the speed of the traction cable Vc.

When the vehicle is towed at the speed of the traction cable Vc, the rotatable elements 17 to 20 are in contact with the traction cable 2 and are immobile in rotation, and in this case the vehicle is towed by the traction cable 2, in particular due to the adherence of the rotatable elements on the traction cable 2.

A preferred mode of use of the coupling device 15 can be described in the following manner: a vehicle 3 is initially positioned in the return station 8, and is then towed by the traction cable 2 to the drive station 9, is uncoupled from the traction cable 2 to run around the driving pulley 12, and is then coupled to the traction cable 2 again to be driven to the intermediate station 10. The vehicle 3 is then immobilized in the intermediate station. Throughout this mode of use, the traction cable 2 is driven in rotation by the driving pulley 12 at the running speed Vc.

In the initial position, the fastening 16 is in the open position O, the transmission belt 38 is in position C, and the vehicle 3 runs along the bypass circuit C1. Then the vehicle 3 is placed at the level of the output cam 25 of the return station 8. Advantageously the vehicle 3 can be immobilized at the level of the output cam 25. To insert the traction cable 2, or to extract the traction cable 2, in the housing 21 of the fastening 16, the vehicle 3 is placed so as to make the main axis 22 coincide with the taut traction cable 2. The output cam 25 causes closing of the fastening 16 and the rotatable elements 17 to 20 are in contact with the traction cable 2 and are driven in rotation by the traction cable 2, and their tangential speed Vtg is equal to the running speed Vc of the traction cable 2, with Vtg=Vc. Then the transmission belt 38 is moved to position B. In position B, the tangential speed Vtg of the rotatable elements 17 to 20 decreases and the friction of the rotatable elements 17 to 20 against the traction cable increases. The increased friction results in an increase of the tangential speed Vtr of the wheels 27 to 30 of the carriage 26. In position B, the vehicle 3 starts to be towed as the tangential speed of the wheels Vtr increases on account of the equation Vtr=Vc−Vtg. The transmission belt 38 is then moved to position A, in which the tangential speed Vtg of the rotatable elements 17 to 20 is zero. In position A, the tangential speed Vtr of the wheels 27 to 30 of the carriage 26 is equal to the running speed Vc of the traction cable 2, with Vtr=Vc. In position A, the vehicle 3 is towed by the traction cable 2 at the running speed Vc and the vehicle 3 leaves the return station 8. It can thus be noted that the stations 8 to 10 of the installation 1 no longer have to be provided with a long and complex acceleration section, as the vehicle 3 can be coupled to the traction cable 2 from an immobile position of the vehicle 3.

To slow the vehicle 3 down, when the latter reaches the drive station 9, the transmission belt 38 is moved from position A to position B. In position B, the running speed Vc remains constant, the tangential speed Vtg of the rotatable elements 17 to 20 increases, and the tangential speed Vtr of the wheels 27 to 30 of the carriage 26 decreases on account of the relationship Vtr=Vc−Vtg. The vehicle 3 therefore slows down, in particular on account of the decrease of the tangential speed of the wheels Vr of the carriage 26. The transmission belt 38 is then moved again from position B to position C. In position C, the tangential speed Vtg of the rotatable elements 17 to 20 is equal to the running speed Vc of the traction cable 2 as the rotatable elements 17 to 20 adhere to the traction cable 2 and as they are driven by the traction cable 2 by friction. Furthermore, in position C, the tangential speed Vtr of the wheels 27 to 30 of the carriage 26 is zero and the vehicle 3 is immobile in the drive station 9. It can thus be noted that the stations 8 to 10 of the installation 1 no longer have to be provided with a long and complex slowing-down section.

When the vehicle 3 is stopped in the drive station 9, the fastening 16 is opened, opening of the latter being able to be brought about by the input cam 24 of the station 9 or by the control unit 32, and the traction cable 2 is extracted from the housing 21 of the fastening 16. It can be noted that the control unit 32 can also be connected by a connection 47 to the adhering means 23 to command opening and closing of the fastening 16. Opening of the fastening 16 is obtained by lateral movement of the rotatable elements 17 to 20 on each side of the main axis 22 of the housing 21 so as to release the housing 21 to extract the cable 2 from the fastening 16. More particularly, to extract the cable 2 from the housing 21, the cable 2 is diverted upwards or downwards in the terminal station 8, 9 by diverting sheaves, not represented here for the sake of simplification. Opening of the fastening 16 is generally performed in a terminal station 8, 9 to make the vehicle run around the pulley 12, 13 of the station 8, 9. The vehicle 3 is then uncoupled from the traction cable 2 and can run along the bypass circuit C2 to run around the driving pulley 12. The terminal stations 8, 9 generally comprise motorized tyre systems to move the vehicles along the bypass circuits C1, C2.

Advantageously, the vehicle 3 can be immobilized in the intermediate station 10, whereas the traction cable 2 remains driven at the running speed Vc, and the fastening 16 is in the closed position F. It is therefore no longer necessary to uncouple the vehicle 3 from the traction cable 2 to immobilize the vehicle 3.

Figure 4:
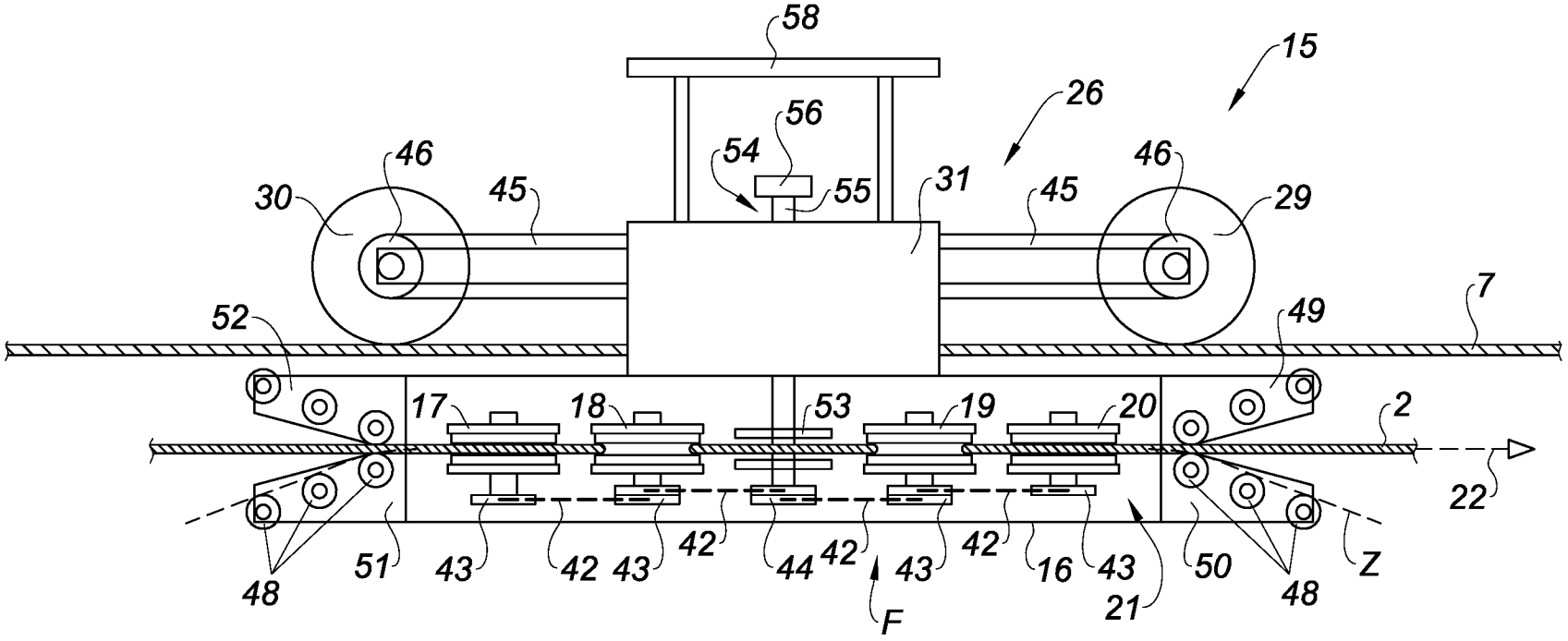
FIG. 4 schematically illustrates a side view of the device of FIG. 2.
Figure 5:
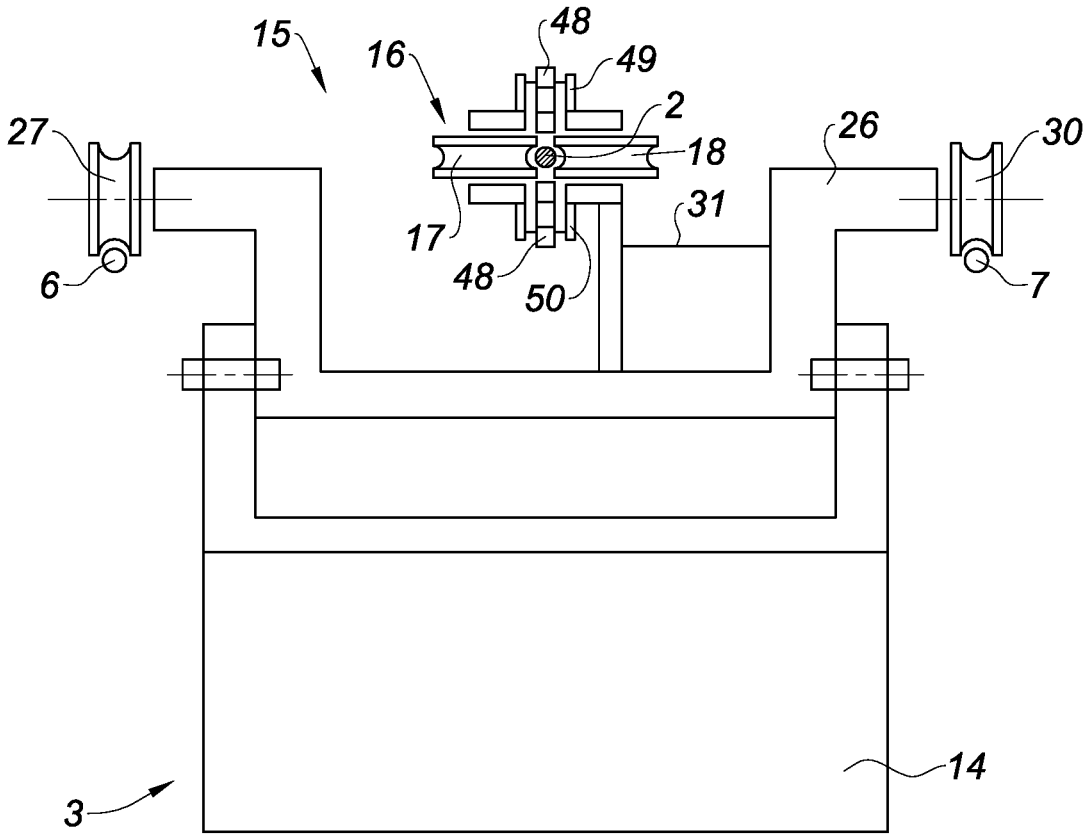
FIG. 5 schematically illustrates a front view of another embodiment of a coupling device.

Advantageously, the coupling device 15 can comprise guide means situated along the main axis 22 when the rotatable elements are in the coupling position F. The guide means can be rounded elements to limit friction when they are in contact with the traction cable 2. Preferably, the guide means comprise pairs of guide sheaves 48 to hold the portion of the traction cable 2 in the housing 21, in particular when the fastening 16 passes over a pillar on the line. The guide sheaves 48 are mounted on sheave supports 49 to 52. In particular, the guide sheaves 48 are mounted movable in rotation according axes perpendicular to the main axis 22 of the housing 21 and perpendicular to the central axes of the blocking sheaves 17 to 20. Furthermore, the sheave supports 49 to 52 are mounted movable in translation according to axes parallel to the axis of translation T of the blocking sheaves 17 to 20. Preferably, the fastening 16 comprises four sheave supports 49 to 52, a front top sheave support 49, a front bottom sheave support 50, a rear bottom sheave support 51 and a rear top sheave support 52. The front and rear are defined relative to the direction of the main axis 22 oriented in the direction of movement Y of the vehicle. The top and bottom parts are defined relative to the central axes of the blocking sheaves 17 to 21. Each pair of guide sheaves 48 further comprises a sheave mounted on a top sheave support 49, 52 and a sheave mounted on a bottom sheave support 50, 51, so that the guide sheaves 48 of each pair are situated facing one another. The sheave supports 49 to 52 are movable in translation between a holding position illustrated in FIG. 2, and a released position illustrated in FIG. 3. In the holding position, the guide sheaves 48 are situated along the main axis 22 of the housing 21 to hold the traction cable 2 inside the fastening 16. The cable 2 can then be prevented from coming out of the fastening 16 when the vehicle 3 to 5 passes over a line pillar supporting or compressing the traction cable 2. In the released position, the guide sheaves 48 are situated laid back from the main axis 22 to extract the traction cable 2 from the housing 21. The guide sheaves 48 are particularly suitable to take the variations of incline of the traction cable 2 along the path of the vehicle 3 into account. In FIG. 4, a side view of an embodiment of the coupling device 15 has been represented. FIG. 4 illustrates the role of the sheave supports 49 to 52. When the coupling device 15 passes over a support pillar of the traction cable 2, the cable 2 is flexed with a concavity in the downward direction. The cable 2 tends to take the position represented in a broken line by the reference Z. In this case, the traction cable 2 presses on the guide sheaves 48 of the bottom sheave supports 50, 51. The bottom sheave supports 50, 51 therefore enable the traction cable 2 to be hold in the housing 21. More particularly, the bottom sheave supports 50, 51 hold the two ends of the portion of the cable aligned with the main axis 22 of the housing 21. In opposite manner, when the coupling device 15 passes over a pillar compressing the traction cable 2, the cable is flexed with a concavity in the upward direction. In this case, the traction cable 2 presses on the guide sheaves 48 of the top sheave supports 49, 52. The top sheave supports 49, 52 therefore enable to hold the two ends of the portion of cable aligned with the main axis 22 of the housing 21. According to another advantage, the carriage 26 can comprise a moving device 58 which cooperates with a set of tyres of the bypass circuits C1, C2 to move the vehicles 3 to 5 in these circuits C1, C2.

The adherence of the detachable fastening 16 can be further enhanced, for example by providing the fastening 16 with an additional detachable grip 53. The detachable grip 53 is controlled to open or close when the fastening 16 is in the closed position F. The additional grip 53 enables the vehicle to be towed in case of large inclines of the traction cable 2.

The coupling device 15 can also comprise a launcher 54, as illustrated in FIG. 4, to drive the rotatable elements 17 to 20 in rotation when the fastening 16 is in the open position O. In this way, when the fastening 16 is closed, the blocking sheaves 17 to 20 rotate, which limits the friction when they are in contact with the moving traction cable 2. The launcher 54 can comprise a rod 55 having a first end connected to the toothed wheel 44 and a second end connected to a launching wheel 56. The terminal stations 8, 9 of the installation 1 can in this case comprise a motorized drive system 57 to drive the launching wheel 56 in rotation, and therefore the rotatable elements 17 to 20. Preferably, the motorized drive systems 57 drive the rotatable elements 17 to 20 in rotation when the fastening 16 is in the open position O, before closing. The motorized drive system 57 enables the rotatable elements 17 to 20 to be driven in rotation at a tangential speed Vtg corresponding to that of the traction cable 2, thus preventing wear.

Advantageously, a part of the mechanical power provided by the traction cable can be recovered as energy to operate devices of the vehicle 3 to 5, such as for example a lighting device, air conditioning, or any type of electronic device such as the control unit 32, in order to provide an autonomous vehicle. In particular, the mechanical power can be recovered when the vehicle 3 to 5 is on the line, in that case a part of the power provided by the input shaft 34, or the output shaft 35, which is driven in rotation, is recovered. Mechanical power can also be recovered when the vehicle 3 to 5 is stopped with the rotatable elements in the coupling position F, in that case a part of the power provided by the input shaft 34 which is driven in rotation is recovered. It can be envisaged to recover mechanical power when the vehicle 3 to 5 is running along a bypass circuit C1 to C2, from the power provided by the output shaft 35 which is driven in rotation.

When an emergency stop request of a vehicle is made, all the vehicles 3 to 5 can be stopped only by stopping the traction cable 2. This provides a considerable advantage for safety of people compared with installations of tramway type where a vehicle can collide with another vehicle.

Figure 10:
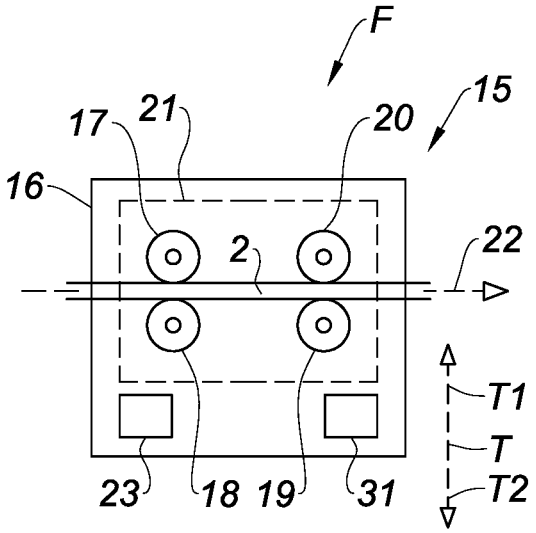
FIGS. 10 and 11 schematically illustrate top views of another embodiment of a fastening where the rotatable elements are respectively in the coupling position and the uncoupling position.
Figure 11:
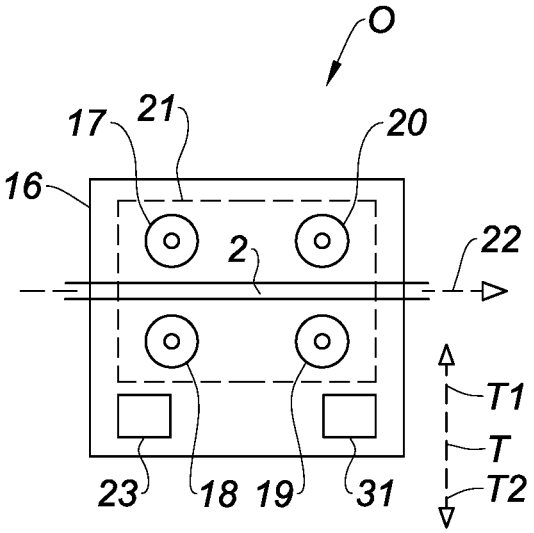

In FIGS. 10 and 11, a particular embodiment of the fastening 16 has been represented. In this particular embodiment, the fastening 16 comprises at least four rotatable elements 17 to 20 arranged in such a way that the traction cable 2 is rectilinear in the housing 21 when the four rotatable elements 17 to 20 are in the coupling position F. In other words, the traction cable 2 extends longitudinally along the main axis 22 of the housing 21. Such a fastening 16 makes it possible to reduce the forces to be provided on each of the four rotatable elements 17 to 20 to grip the traction cable 2, compared with the configuration illustrated in FIGS. 6 and 7 in which the fastening 16 comprises two rotatable elements 17, 18. This thereby enhances the safety with which the vehicle is attached to the traction cable 2. As illustrated in FIGS. 10 and 11, the fastening 16 comprises two pairs of rotatable elements 17 to 20, each pair comprising two rotatable elements located facing one another. It could be envisaged for the fastening 16 to comprise several pairs of rotatable elements arranged in series next to one another along the main axis 22. In particular, the rotatable elements 17 to 20 are located on each side of the fastening 16, i.e. on each side of the main axis 22. Preferentially, the fastening 16 comprises four blocking sheaves 17 to 20 forming two pairs, two sheaves 17, 20 being situated on one side of the main axis 22 and two other sheaves 18, 19 being situated on the other side. In particular, the axis connecting the centres of the blocking sheaves of one and the same pair is perpendicular to the traction cable 2 when the blocking sheaves are in the coupling position F. The fastening 16 can be configured to couple the vehicle 3 to 5 to the traction cable 2 in removable manner, as illustrated in FIGS. 10 and 11, or in fixed manner. In FIG. 10, the rotatable elements 17 to 20 are in the coupling position F and they are in contact on the two opposite sides of the traction cable 2. In the coupling position F, the rotatable elements 17 to 20 cooperate with one another to grip the traction cable 2 in order to couple the vehicle to the traction cable 2. Indeed, when the four rotatable elements 17 to 20 are in the coupling position F, they exert the griping pressure on the traction cable 2.

The invention that has just been described is particularly suitable for any type of transport installation by cable, in particular an installation with an overhead or ground traction cable. The invention enables the transit rate of an installation to be increased by minimizing the size of the stations, in particular without their size having to be increased by providing them with complex and voluminous launching and deceleration sections.

The invention claimed is:

1. A device for coupling a vehicle to a traction cable, comprising a fastening configured to couple the vehicle to the traction cable, wherein the fastening comprises at least three rotatable elements configured to occupy a coupling position in which said at least three rotatable elements are in contact with the traction cable, the vehicle is coupled to the traction cable and said at least three rotatable elements are arranged to bend a portion of the traction cable inside the fastening, the device comprising a variable speed drive configured to modify a speed of rotation of said at least three rotatable elements when said at least three rotatable elements are in the coupling position, so that the vehicle moves relative to the traction cable.

2. The device according to claim 1, wherein the variable speed drive is further configured to block said at least three rotatable elements in rotation when said at least three rotatable elements are in the coupling position, so that the vehicle is immobile relative to the traction cable.

3. The device according to claim 1, wherein each rotatable element comprises at least one sheave mounted movable in rotation.

4. The device according to claim 1, wherein the variable speed drive is coupled to at least one rotatable element.

5. The device according to claim 4, comprising a carriage on which the fastening is mounted, the carriage comprising wheels designed to roll on a support structure, the variable speed drive being controlled and provided with an input shaft coupled to said at least one rotatable element and with an output shaft coupled to the input shaft and to at least one wheel of the carriage, the device comprising a control unit coupled to the variable speed drive to control the speed of rotation of said at least three rotatable elements.

6. The device according to claim 5, wherein the variable speed drive comprises two cones arranged head-to-tail and respectively coupled to the input shaft and output shaft, and a transmission belt connected to the two cones, the control unit being configured to move the transmission belt in order to control the speed of rotation of said at least three rotatable elements.

7. The device according to claim 1, wherein at least one rotatable element is mounted movable in translation between the coupling position in which the vehicle is coupled to the traction cable and an uncoupling position in which the vehicle is uncoupled from the traction cable.

8. The device according to claim 1, wherein the fastening comprises a housing to receive the traction cable, the housing extending along a main axis, the device comprising a guide situated along the main axis when said at least three rotatable elements are in the coupling position, in order to hold the traction cable in the housing.

9. A vehicle designed to be coupled to a traction cable, comprising a device according to claim 1.

10. A transport installation by traction cable, comprising at least one vehicle according to claim 9.

11. The installation according to claim 10, comprising a support structure to support said at least one vehicle.

12. A device for coupling a vehicle to a traction cable, comprising a fastening configured to couple the vehicle to the traction cable and comprising a housing to receive the traction cable, wherein the fastening comprises at least four rotatable elements configured to occupy a coupling position in which said at least four rotatable elements are in contact with the traction cable, the vehicle is coupled to the traction cable, said at least four rotatable elements are arranged to bend a portion of the traction cable inside the fastening, and the traction cable is rectilinear in the housing, the device comprising a variable speed drive configured to modify a speed of rotation of said at least four rotatable elements when said at least four rotatable elements are in the coupling position, so that the vehicle moves relative to the traction cable.

13. The device according to claim 12, wherein the variable speed drive is further configured to block said at least four rotatable elements in rotation when said at least four rotatable elements are in the coupling position, so that the vehicle is immobile relative to the traction cable.

14. The device according to claim 12, wherein each rotatable element comprises at least one sheave mounted movable in rotation.

15. The device according to claim 12, wherein the variable speed drive is coupled to at least one rotatable element.

16. The device according to claim 15, comprising a carriage on which the fastening is mounted, the carriage comprising wheels designed to roll on a support structure, the variable speed drive being controlled and provided with an input shaft coupled to said at least one rotatable element and with an output shaft coupled to the input shaft and to at least one wheel of the carriage, the device comprising a control unit coupled to the variable speed drive to control the speed of rotation of said at least four rotatable elements.

17. The device according to claim 16, wherein the variable speed drive comprises two cones arranged head-to-tail and respectively coupled to the input shaft and output shaft, and a transmission belt connected to the two cones, the control unit being configured to move the transmission belt in order to control the speed of rotation of said at least four rotatable elements.

18. The device according to claim 12, wherein at least one rotatable element is mounted movable in translation between the coupling position in which the vehicle is coupled to the traction cable and an uncoupling position in which the vehicle is uncoupled from the traction cable.

19. The device according to claim 18, comprising a launcher to move at least one rotatable element in rotation when said at least one rotatable element is in the uncoupling position.

20. The device according to claim 12, wherein the fastening comprises a housing to receive the traction cable, the housing extending along a main axis, the device comprising a guide situated along the main axis when said at least four rotatable elements are in the coupling position, in order to hold the traction cable in the housing.

21. The device according to claim 12, further comprising a detachable grip configured to couple the vehicle to the traction cable in removable manner.

22. A vehicle designed to be coupled to a traction cable, comprising a device according to claim 12.

23. A transport installation by traction cable, comprising at least one vehicle according to claim 22.

24. The installation according to claim 23, comprising a support structure to support said at least one vehicle.

* * * * *